US006533555B2

(12) United States Patent
Yamada et al.

(10) Patent No.: US 6,533,555 B2
(45) Date of Patent: Mar. 18, 2003

(54) SWASH PLATE TYPE COMPRESSOR

(75) Inventors: Takeshi Yamada, Kariya (JP); Naoya Yokomachi, Kariya (JP); Masakazu Murase, Kariya (JP); Toshiro Fujii, Kariya (JP); Junya Suzuki, Kariya (JP); Tatsuya Koide, Kariya (JP); Takayuki Imai, Kariya (JP); Kiyoshi Yagi, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 70 days.

(21) Appl. No.: 09/879,383

(22) Filed: Jun. 12, 2001

(65) Prior Publication Data

US 2001/0053328 A1 Dec. 20, 2001

(30) Foreign Application Priority Data

| | | |
|---|---|---|
| Jun. 13, 2000 | (JP) | 2000-176660 |
| Jun. 19, 2000 | (JP) | 2000-182840 |
| Jan. 15, 2001 | (JP) | 2001-006530 |
| Mar. 22, 2001 | (JP) | 2001-083346 |

(51) Int. Cl.[7] ..... F04B 1/26
(52) U.S. Cl. ..... 417/222.2
(58) Field of Search ..... 417/222.2, 365, 417/201, 269; 92/71

(56) References Cited

U.S. PATENT DOCUMENTS

| | | | | |
|---|---|---|---|---|
| 4,174,191 A | * | 11/1979 | Roberts | 417/222.1 |
| 5,603,610 A | * | 2/1997 | Kawaguchi et al. | 417/222.2 |
| 5,842,834 A | * | 12/1998 | Kawaguchi et al. | 417/222.2 |
| 6,398,515 B1 | * | 6/2002 | Yokomachi et al. | 417/201 |
| 6,402,480 B1 | * | 6/2002 | Sud et al. | 417/222.1 |
| 6,412,171 B1 | * | 7/2002 | Kato et al. | 29/888.04 |
| 6,416,297 B1 | * | 7/2002 | Kawaguchi et al. | 417/222.2 |
| 6,422,129 B1 | * | 7/2002 | Yokomachi et al. | 92/153 |

FOREIGN PATENT DOCUMENTS

| | | | |
|---|---|---|---|
| EP | 0 926 342 A2 | 6/1999 | F04B/27/10 |
| JP | 8-165987 | 6/1996 | F04B/27/14 |
| JP | 11-241681 | 9/1999 | F04B/39/00 |

* cited by examiner

*Primary Examiner*—Teresa Walberg
*Assistant Examiner*—Vinod D Patel
(74) *Attorney, Agent, or Firm*—Morgan & Finnegan, LLP

(57) ABSTRACT

A shaft sealing assembly is located in a suction chamber of a swash plate type compressor to seal the space between a drive shaft and a housing. A first end portion of the drive shaft is supported by a first radial bearing. A second end portion of the drive shaft is supported by a second radial bearing. The suction chamber is closer to the first end portion of the drive shaft than the first radial bearing is. An axial passage is formed in the drive shaft to connect the suction chamber to the crank chamber. An inlet of the axial passage is closer to the second end portion than the second radial bearing is. An outlet of the axial passage is closer to the second end portion than the first radial bearing is.

13 Claims, 6 Drawing Sheets

SWASH PLATE TYPE COMPRESSOR

BACKGROUND OF THE INVENTION

The present invention relates to a swash plate type compressor that has single headed pistons and is used in an air conditioner of a vehicle, and more particularly, to improvement of a radial bearing that supports a drive shaft for reciprocating the pistons and to improvement of a lubricating structure of a shaft sealing assembly.

As shown in FIG. 6, the housing of a typical swash plate type compressor includes a front housing member 71, a cylinder block 72 and a rear housing member 73, which are secured to one another. A drive shaft 74 has a first end and a second end. The drive shaft 74 is supported by the housing through a first and second radial bearings 75, 76 such that the first end protrudes from the front housing member 71. A shaft sealing assembly 78 is located about the drive shaft 74 at a position between the first end and the first radial bearing 75. The sealing assembly 78 prevents refrigerant gas from leaking from a crank chamber 77 to the atmosphere.

Moving parts of a compressor such as bearings are lubricated by misted lubricant contained in refrigerant gas. Therefore, parts where refrigerant gas is stagnant are not effectively lubricated. A compressor that uses carbon dioxide ($CO_2$) for a cooling circuit instead of chlorofluorocarbon has been introduced. When using $CO_2$ as refrigerant, the refrigerant pressure is more than ten times that of a case where chlorofluorocarbon is used as refrigerant, which increases the load acting on bearings and shaft sealing assemblies. Accordingly, lubrication must be improved.

In the compressor of Japanese Unexamined Patent Publication No. 11-241681, the shaft sealing assembly 78 is located in an isolated chamber 80, which is forward of the first radial bearing 75. A decompression passage 79 is formed in the drive shaft 74. An outlet 79*b* of the decompression passage 79 opens to the end face of the second end of the drive shaft 74. A fan 81 is attached to the second end of the drive shaft 74. When the fan 81 rotates integrally with the drive shaft 74, refrigerant in the decompression passage 79 is drawn to the outlet 79*b*. The refrigerant then flows to the crank chamber 77 through the radial bearing 76.

The isolated chamber 80 is connected to the crank chamber 77 through the space in the radial bearing 75 and the space in a thrust bearing 82. The spaces in the radial bearing 75 and the thrust bearing 82 function as oil supplying passages.

Japanese Unexamined Patent Publication No. 8-165987 discloses a compressor shown in FIG. 7. In this compressor, a second end of the drive shaft 74 faces a chamber 84 that communicates with a suction chamber 83. An axial passage 85 is formed in the drive shaft 74. The inlet 85*a* of the passage 85 opens to an isolated chamber 80. The outlet 85*b* of the passage 85 opens to the chamber 84.

In the compressor of FIG. 6, the fan 81 attached to the drive shaft 74 draws some of refrigerant gas into the decompression passage 79 through the first radial bearing 75 or through the thrust bearing 82. The drawn refrigerant gas then returns to the crank chamber 77 through the second radial bearing 76. Accordingly, the radial bearings 75, 76 and the shaft sealing assembly 78 are reliably lubricated. However, to flow lubricant through the decompression passage 79, the fan 81 is required, which complicates the structure.

Instead of a fan, the chamber 84 is located adjacent to the second end of the drive shaft 74 of the compressor shown in FIG. 7, and the passage 85 is formed in the drive shaft 74 to connect the isolated chamber 80 with the chamber 84. Thus, refrigerant flows through the radial bearings 75, 76 or through the thrust bearing 82 in accordance with the pressure difference between the crank chamber 77 and the chamber 84. However, since the inlet 85*a* is located between the shaft sealing assembly 78 and the thrust bearing, flow of refrigerant is weakened either in the shaft sealing assembly 78 or in the thrust bearing, which results in insufficient lubrication.

BRIEF SUMMARY OF THE INVENTION

Accordingly, it is an objective of the present invention to provide a swash plate type compressor that includes a simple structure for effectively lubricating radial bearings, which support a drive shaft, and a shaft sealing assembly.

To achieve the foregoing and other objectives and in accordance with the purpose of the present invention, a swash plate type compressor is provided. The compressor includes a housing, a drive shaft, first and second radial bearings, a piston, a cam plate, a shaft sealing assembly. A suction chamber, a discharge chamber and a crank chamber are defined in the housing. The housing has at least one cylinder bore. The drive shaft is rotatably supported by the housing and has a first end portion and a second end portion. The first end portion protrudes from the housing. The first and second radial bearings support the first and second end portions of the drive shaft, respectively. The piston is reciprocally accommodated in the cylinder bore. The cam plate is accommodated in the crank chamber and is operably coupled to the piston to convert rotation of the drive shaft into reciprocation of the piston. The shaft sealing assembly seals the space between the drive shaft and the housing and is accommodated in the suction chamber. The suction chamber is closer to the first end portion of the drive shaft than the first radial bearing is. A passage is formed in the drive shaft to connect the suction chamber to the crank chamber. The passage has an inlet and an outlet. The inlet is closer to the second end portion than the second radial bearing is. The outlet is closer to the second end portion than the first radial bearing is.

Other aspects and advantages of the invention will become apparent from the following description, taken in conjunction with the accompanying drawings, illustrating by way of example the principles of the invention.

BRIEF DESCRIPTION OF THE SEVERAL VIEWS OF THE DRAWING

The invention, together with objects and advantages thereof, may best be understood by reference to the following description of the presently preferred embodiments together with the accompanying drawings in which:

FIG. 2(*b*) is an enlarged partial cross-sectional view illustrating the outlet of the axial passage of the compressor shown in FIG. 1;

FIG. 2(*c*) is an enlarged partial cross-sectional view illustrating a second end of the drive shaft of the compressor shown in FIG. 1;

DETAILED DESCRIPTION OF THE PREFERRED EMBODIMENTS

Figure 1:
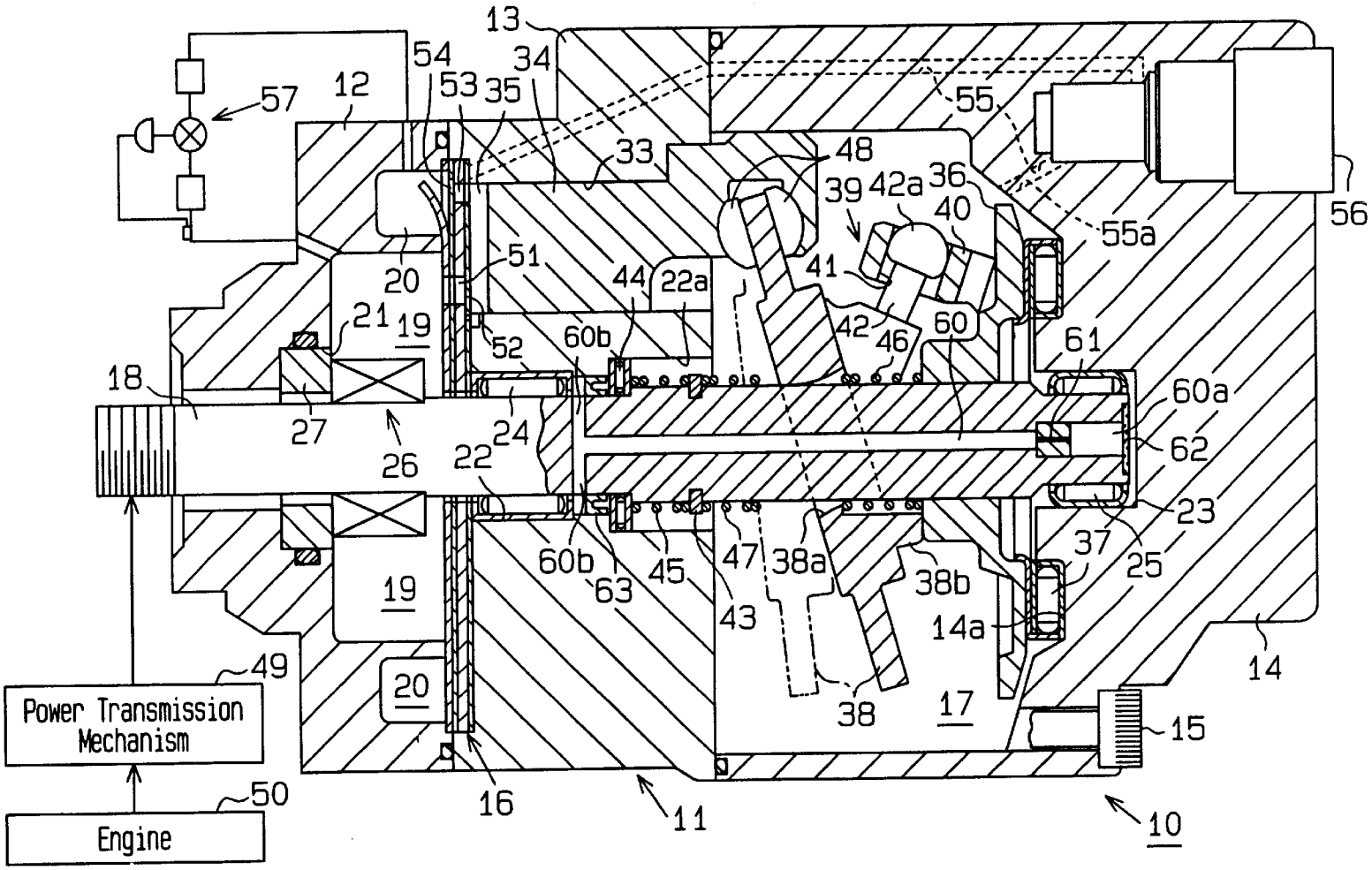
FIG. 1 is a cross-sectional view illustrating a compressor according to a first embodiment of the present invention.

A variable displacement compressor 10 for vehicle air conditioner according to a first embodiment of the present invention will now be described with reference to FIGS. 1 and 2. As shown in FIG. 1, the housing 11 of the compressor 10 includes a front housing member 12, a cylinder block 13 and a rear housing member 14, which are arranged in the order of the front housing member 12, the cylinder block 13 and the rear housing member 14 from a first end (left end as viewed in FIG. 1) of the housing 11. The front housing member 12, the cylinder block 13 and the rear housing member 14 are secured to one another by bolts (not shown). A valve plate assembly 16 is located between the front housing member 12 and the cylinder block 13. A crank chamber 17 is defined between the cylinder block 13 and the rear housing member 14.

A drive shaft 18 extends through a hole formed in the valve plate assembly 16. The drive shaft 18 is rotatably supported by the housing 11 such that a first end of the drive shaft 18 protrudes from the front housing member 12 and a second end is located in the crank chamber 17. A suction pressure zone, which is a suction chamber 19 in this embodiment, is defined in the front housing member 12. The suction chamber 19 is located in the vicinity of the first end of the drive shaft 18. A discharge chamber 20 is defined in the front housing member 12 and surrounds the suction chamber 19. A ring recess 21 is formed in the front housing member 12. The ring recess 21 opens to the suction chamber 19 and faces the valve plate assembly 16. A shaft hole 22 is formed in the cylinder block 13 to communicate the crank chamber 17 with the suction chamber 19. A bearing recess 23 is formed in the rear housing member 14. The bearing recess 23 opens to the crank chamber 17 and forms part of the crank chamber 17.

The drive shaft 18 extends through the shaft hole 22, the suction chamber 19, the ring recess 21 and a through hole formed in the front housing member 12. The middle portion of the drive shaft 18 is rotatably supported by the cylinder block 13 through a first radial bearing 24, which is located in the shaft hole 22. The second end of the drive shaft 18 is rotatably supported by the rear housing member 14 through a second radial bearing 25, which is located in the recess 23.

A sealing assembly 26, which is a mechanical seal, is located in the suction chamber 19. As shown in FIG. 2(*a*), the sealing assembly 26 includes a stationary ring 27, which is fitted in the recess 21, and a carbon sliding ring 29, which is fixed to the drive shaft 18 through an O-ring 28. The sliding ring 29 rotates integrally with the drive shaft 18 and slides along the stationary ring 27. The stationary ring 27 is loosely fitted to the drive shaft 18, and an O-ring 30 is located between the stationary ring 27 and the front housing member 12. A circumferential groove 29*a* is formed in the outer surface of the sliding ring 29. The sealing assembly 26 also includes a support ring 31, which rotates integrally with the drive shaft 18. The support ring 31 includes an engaging portion 31*a*, which is engaged with the groove 29*a* of the support ring 31. The support ring 31 also includes a spring 32, which urges the sliding ring 29 toward the stationary ring 27. The space between the drive shaft 18 and the housing 11 is sealed by the O-ring 28, the sliding ring 29, the stationary ring 27 and the O-ring 30.

Cylinder bores 33 (only one shown) are formed in the cylinder block 13 about the drive shaft 18. The cylinder bores 33 are arranged at equal angular intervals about the drive shaft 18. That is, the cylinder bores 33 are formed in the housing 11 between the crank chamber 17 and the valve plate assembly 16. A single-headed piston 34 is housed in each cylinder bore 33. The front and rear openings of each cylinder bore 33 is blocked by the valve plate assembly 16 and the corresponding piston 34, respectively. Each piston 34 and the corresponding cylinder bore 33 define a compression chamber 35, the volume of which is changed according to reciprocation of the piston 34.

A rotating support, which is a lug plate 36 in this embodiment, is secured to the drive shaft 18 in the vicinity of the second end of the drive shaft 18. The lug plate 36 rotates integrally with the drive shaft 18. The lug plate 36 is received by the rear housing member 14 through a first thrust bearing 37. An inner wall 14*a* receives the axial load generated by compression reaction force of the pistons 34 and functions as a restriction surface that defines the axial position of the drive shaft 18.

A cam plate, which is a swash plate 38 in this embodiment, is located in the crank chamber 17. A through hole 38*a* is formed in the swash plate 38 and the drive shaft 18 extends through the hole 38*a*. A hinge mechanism 39 is located between the lug plate 36 and the swash plate 38. The hinge mechanism 39 includes two support arms 40 (only one is shown) and two guide pins 42 (only one is shown). Each support arm 40 projects from the front side of the lug plate 36. A guide hole 41 is formed in each support arm 40. Each guide pin 42 includes a spherical portion 42*a*, which is engaged with the corresponding guide hole 41. The hinge mechanism 39 permits the swash plate 38 to rotate integrally with the lug plate 36 and the drive shaft 18. The hinge mechanism 39 also permits the swash plate 38 to slide along the drive shaft 18 and to tilt with respect to the axis of the drive shaft 18. The lug plate 36 and the hinge mechanism 39 form an inclination angle control means. The swash plate 38 has a counterweight 38*b* located at the opposite side of the drive shaft 18 from the hinge mechanism 39.

A snap ring 43 is fixed to the drive shaft 18. The snap ring 43 is located in a large diameter portion 22*a* of the shaft hole 22. A second thrust bearing 44 is fitted to the drive shaft 18 and is located in the large diameter portion 22*a*. A first coil spring 45 is fitted about the drive shaft 18 and extends between the snap ring 43 and the second thrust bearing 44. The first coil spring 45 urges the drive shaft 18 toward the restriction surface (the inner wall surface 14*a* of the rear housing member 14) at least when the compressor 10 is not running.

A second coil spring 46 is fitted about the drive shaft 18 between the lug plate 36 and the swash plate 38. The second coil spring 46 urges the swash plate 38 toward the cylinder block 13, or in the direction decreasing the inclination angle.

A restoring spring, which is a third coil spring 47 in this embodiment, is fitted about the drive shaft 18 between the swash plate 38 and the snap ring 43. When the swash plate 38 at a large inclination position (the position illustrated by solid lines in FIG. 1), the coil spring 47 remains at the normal length and applies no force to the swash plate 38. When the swash plate 38 is at a small inclination position as illustrated by broken lines, the third coil spring 47 is compressed between the swash plate 38 and the snap ring 43 and urges the swash plate 38 away from the cylinder block 13, or in the direction increasing the inclination angle, by a force that corresponds to the compression amount.

Each piston 34 is coupled to the circumferential portion of the swash plate 38 through a pair of shoes 48. When the swash plate 38 rotates integrally with the drive shaft 18, rotation is converted into reciprocation of each piston 34 by the corresponding shoes 48. The swash plate 38 and the shoes 48 are made of iron-based metal. Sliding portions of the swash plate 38 and the shoes 48 are treated to prevent seizing. For example, an aluminum-based metal is thermal sprayed or friction welded onto the sliding portions of the swash plate 38 and the shoes 48.

The drive shaft 18 is coupled to an engine 50 by a power transmission mechanism 49. In this embodiment, the power transmission mechanism 49 is a clutchless mechanism that includes, for example, a belt and a pulley. The power transmission mechanism 49 therefore constantly transmits power from the engine 50 to the compressor when the engine 50 is running. Alternatively, the mechanism 49 may be a clutch mechanism (for example, an electromagnetic clutch) that selectively transmits power when supplied with a current.

The valve plate assembly 16 has suction ports 51 and discharge ports 53, which correspond to each cylinder bore 33. The valve plate assembly 16 also has suction valve flaps 52, each of which corresponds to one of the suction ports 51, and discharge valve flaps 54, each of which corresponds to one of the discharge ports 53. Each cylinder bore 33 is connected to the suction chamber 19 through the corresponding suction port 51 and is connected to the discharge chamber 20 through the corresponding discharge port 53.

A supply passage 55 is formed in the cylinder block 13 and the rear housing member 14 to connect the crank chamber 17 with the discharge chamber 20. A control valve 56 regulates the supply passage 55 to control the inclination angle of the swash plate 38. The outlet 55*a* of the supply passage 55 is located above the first thrust bearing 37. The control valve 56 is a conventional electromagnetic valve. The valve chamber of the control valve 56 is located in the supply passage 55. When the solenoid of the control valve 56 is excited, the control valve 56 opens the supply passage 55. When the solenoid is de-excited, the control valve 56 closes the supply passage 55. The opening amount of the supply passage 55 is controlled in accordance with the level of the supplied current.

The suction chamber 19 is connected to the discharge chamber 20 through an external refrigerant circuit 57. The refrigerant circuit 57 and the compressor 10 form the cooling circuit of a vehicle air conditioner.

Figure 2A:
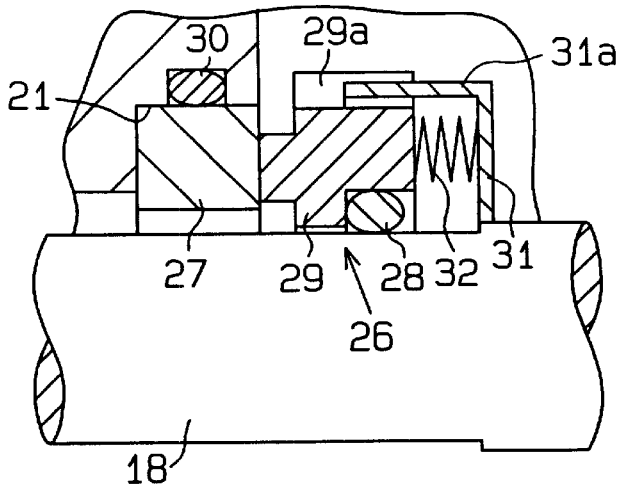
FIG. 2(*a*) is an enlarged partial cross-sectional view illustrating the shaft sealing mechanism of the compressor shown in FIG. 1.
Figure 2B:
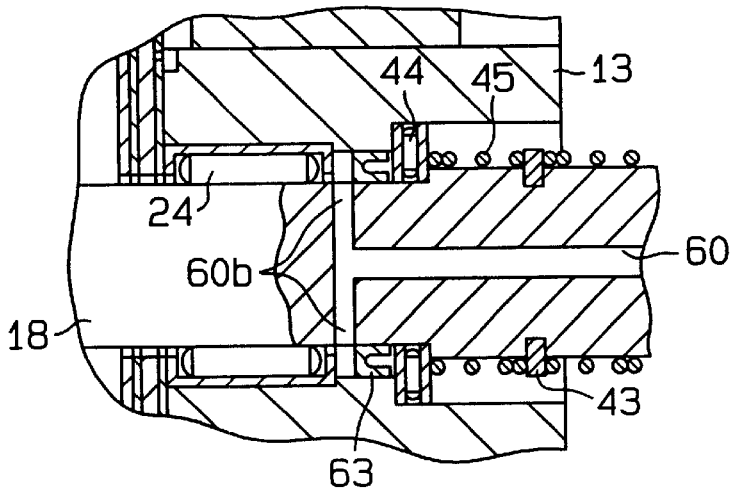
Figure 2C:
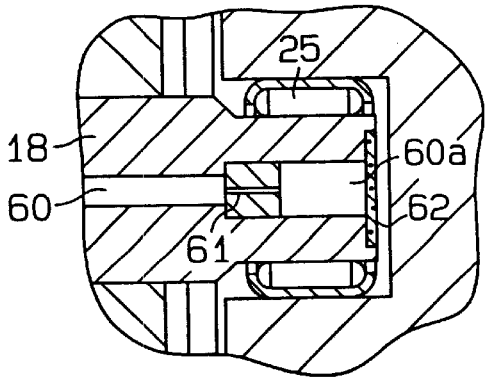

As shown in FIGS. 1, 2(*b*) and 2(*c*), an axial passage 60 is formed in the drive shaft 18. The axial passage 60 forms part of a bleed passage, which connects the suction chamber 19 with the crank chamber 17. The inlet 60*a* of the axial passage 60 is closer to the second end than the second radial bearing is. The outlet 60*b* of the axial passage 60 is closer to the second end than the first radial bearing 24 is. A fixed restrictor 61 is located in the axial passage 60. The restrictor 61 is formed by fitting a plug that has a small through hole into the axial passage 60.

A filter 62 is fixed to the second end of the drive shaft 18 to rotate integrally with the drive shaft 18. The filter 62 covers the inlet 60*a* of the axial passage 60. The filter 62 is made, for example, of a mesh, a plate having many holes or a porous plate.

A seal ring 63 is located in the shaft hole 22 between the outer surface of the drive shaft 18 and the inner wall of the cylinder block 13. The seal ring 63 is located between the outlet 60*b* and the second thrust bearing 44. The seal ring 63 prevents refrigerant in the crank chamber 17 from leaking to the suction chamber 19 through the shaft hole 22. The seal ring 63 is made, for example, of rubber or fluorocarbon resin. The cross section of the seal ring 63 is U-shaped.

The operation of the compressor 10 will now be described.

As the drive shaft 18 rotates, the lug plate 36 and the hinge mechanism 39 permit the swash plate 38 to rotate integrally with the drive shaft 18. Rotation of the swash plate 38 is converted into reciprocation of each piston 34 by the corresponding shoes 48. As a result, suction, compression and discharge of refrigerant gas are repeated in the compression chambers 35. Refrigerant supplied from the external refrigerant circuit 57 to the suction chamber 19 is drawn into each compression chamber 35 through the corresponding suction port 51. The refrigerant is then compressed by the corresponding piston 34 and is discharged to the discharge chamber 20 through the corresponding discharge port 53. Subsequently, the refrigerant is then sent to the external refrigerant circuit 57 through a discharge passage.

In accordance with the cooling load, a controller (not shown) adjusts the opening amount of the control valve 56, or the opening amount of the supply passage 55, to alter the communicating state between the discharge chamber 20 and the crank chamber 17.

When the cooling load is great, the opening amount of the supply passage 55 is decreased to decrease the flow rate of refrigerant gas from the discharge chamber 20 to the crank chamber 17. Accordingly, the pressure in the crank chamber 17 is gradually lowered due to gas flow from the crank chamber 17 to the suction chamber 19 through the axial passage 60. As a result, the difference between the pressure in the crank chamber 17 and the pressure in the cylinder bores 33 via the pistons 34 decreases, which maximizes the inclination angle of the swash plate 38. Accordingly, the stroke of each piston 34 is increased and the compressor displacement is increased.

When the cooling load is decreased, the opening amount of the control valve 56 is increased so that flow rate of refrigerant from the discharge chamber 20 to the crank chamber 17 is increased. When the flow rate of refrigerant supplied to the crank chamber 17 surpasses the flow rate of refrigerant that flows out from the crank chamber 17 to the suction chamber 19 through the axial passage 60, the pressure in the crank chamber 17 is gradually raised. As a result, the pressure difference between the crank chamber 17 and the cylinder bores 33 via the pistons 34 increases, which minimizes the inclination angle of the swash plate 38. Therefore, the stroke of each piston 34 is decreased and the displacement of the compressor is decreased.

When each piston 34 compresses refrigerant gas, the compression reaction force F1 (not shown) of the piston 34 acts on the drive shaft 18 through the corresponding shoes 48, the hinge mechanism 39 and the lug plate 36 and urges the drive shaft 18 toward the rear housing member 14. The second end of the drive shaft 18 receives the pressure Pc (not shown), the direction of which is opposite to that of the compression reaction force F1. The first end receives the atmospheric pressure Pa (not shown), the direction of which is the same as the compression reaction force F1. The atmospheric pressure Pa is lower than the crank pressure Pc. That is, a force F2, which is represented by an equation F2=(Pc−Pa)S, acts on the drive shaft 18 in the opposite direction from that of the compression reaction force F1. In the equation, the element S represents the cross-sectional area of a part of the drive shaft 18 in the crank chamber 17 that corresponds to the seal ring 63. In the conventional structure, the direction of the force F2 is the same as the direction of the compression reaction force F1. In this embodiment, the force F2 acts in the opposite direction from the direction of the compression reaction force F1. Accordingly, the power required to drive the drive shaft 18 is reduced.

If the power transmission mechanism 49 is clutchless type, rotation of the engine 50 is transmitted to the drive shaft 18 when the air conditioner is not operating. At this time, the swash plate 38 is kept at the minimum inclination position, and the pistons 34 compress refrigerant. Thus, the drive shaft 18 receives the compression reaction force F1. However, the force F2, which is based on the difference between the crank pressure Pc and the atmospheric pressure Pa acts on the drive shaft 18 against the compression reaction force F1. Accordingly, power consumption when the air conditioner is not operating is reduced When the compressor is not operating, that is, when the compression reaction force F1 of each piston 34 does not act on the drive shaft 18, no force urges the drive shaft 18 toward the restriction surface. Since the pressure in the housing 11 is higher than the atmospheric pressure Pa, the drive shaft 18 is moved away from the rear housing member 14, which separates the lug plate 36 from the thrust bearing 37. However, in this embodiment, since the first coil spring 45 constantly urges the drive shaft 18 toward the rear housing member 14, the lug plate 36 contacts the thrust bearing 37 when the compressor 10 is not operating.

The crank chamber 17 is connected to the suction chamber 19 by the axial passage 60, which is formed in the drive shaft 18, and the seal ring 63 is located adjacent to the outlet 60*b* of the axial passage 60 and at the side closer the crank chamber 17. Therefore, the path that connects the crank chamber 17 to the suction chamber 19 passes through the space in the first thrust bearing 37, the space between the lug plate 36 and the inner wall of the rear housing member 14, the space in the radial bearing 25, the recess 23, the axial passage 60 and the space in the first radial bearing 24. As a result, based on the pressure difference between the crank pressure Pc and the pressure Ps in the suction chamber 19, refrigerant flows from the crank chamber 17 to the suction chamber 19 through the first thrust bearing 37, the second radial bearing 25, the first radial bearing 24, which reliably lubricates the bearings 37, 25, 24 by lubricant contained in the refrigerant gas.

Also, since refrigerant constantly flows into the suction chamber 19, which accommodates the sealing assembly 26, the sealing assembly 26 is reliably lubricated.

The above embodiment has the following advantages.

(1) In the housing 11, a suction pressure zone for accommodating the sealing assembly 26 of the drive shaft 18 is closer to the first end than the first radial bearing 24 is. The axial passage 60 is formed in the drive shaft 18 to connect the suction pressure zone with the crank chamber 17. The inlet 60*a* of the axial passage 60 is closer to the second end than the second radial bearing 25 is, and the outlet 60*b* is closer to the second end than the first radial bearing 24 is. Therefore, flow of refrigerant gas from the crank chamber 17 to the suction passes through the radial bearings 24, 25, which effectively lubricates the radial bearings 24, 25 by lubricant contained in the refrigerant gas. Compared to the conventional structure, the temperature about the sealing assembly 26 is low due to the refrigerant gas in the suction pressure chamber, which improves the durability.

(2) The seal ring 63 is located closer to the crank chamber 17 than the outlet 60*b* of the axial passage 60 is, which permits gas flow from the crank chamber 17 to the suction pressure zone to pass through the first thrust bearing 37 and the radial bearings 24, 25. Thus, the bearings 24, 25, 37 are effectively lubricated. Refrigerant gas in the crank chamber 17 flows to the suction chamber 19 only through the axial passage 60, which functions as a bleed passage. Therefore, when the compressor displacement is changed, the pressure in the crank chamber 17 is accurately controlled.

(3) The suction chamber 19 and the discharge chamber 20 are located closer to the projecting portion of the drive shaft 18 than the crank chamber 17 is, and the sealing assembly 26 is located in the suction chamber 19. Therefore, compared to a conventional compressor that requires a seal that withstands the difference between the pressure in the crank chamber 17, which is higher than that of the suction chamber 19, and the pressure of the ambient air, the above embodiment extends the life of the sealing assembly 26. Accordingly, the reliability of the shaft sealing is improved. The drive shaft 18 receives the force F2, which is based on the pressure difference between the crank pressure Pc and the atmospheric pressure Pa. The force F2 acts in a direction opposite to that of the compression reaction force F1, which acts on the drive shaft 18. Therefore, compared to a conventional compressor in which the forces F1 and F2 act in the same direction, the above embodiment significantly reduces the power required for driving the drive shaft 18. Also, the life of the thrust bearing 37 is extended. These advantages are particularly pronounced when $CO_2$ is used as refrigerant, or when the pressure in the crank chamber 17 is significantly higher than a case where a chlorofluorocarbon is used. Compared to a fixed displacement compressor, in which the stroke of the pistons is constant, the pressure in the crank chamber 17 is higher and, thus, the advantages are more pronounced in the variable displacement compressor 10.

(4) The axial passage 60, which is formed in the drive shaft 18, functions as a bleed passage, and the fixed restrictor 61 is located in the passage 60. If used as refrigerant, $CO_2$ is highly pressurized in the crank chamber 17. In this case, a slight difference of the cross-sectional area of the bleed passage significantly changes the flow rate of refrigerant supplied to the suction chamber 19 through the bleed passage, which makes it difficult to accurately control the compressor displacement. In this embodiment, however, the restrictor 61 facilitates the control of the compressor displacement.

(5) The discharge chamber 20 is connected to the crank chamber 17 by the supply passage 55. The control valve 56, which is located in the supply passage 55, changes the opening amount of the supply passage 55 to adjust the pressure in the crank chamber 17. Thus, the pressure in the crank chamber 17 is easily controlled.

(6) The shaft sealing assembly 26 is a mechanical seal, which has a high pressure resistance. Therefore, when $CO_2$ is used as refrigerant, or when the pressure in the crank chamber 17 is significantly higher than a case where chlorofluorocarbon is used, the sealing assembly 26 has an effective sealing characteristics. Also, compared to a fixed displacement compressor, in which the stroke of the pistons is constant, the pressure in the crank chamber 17 is higher and, thus, the sealing assembly 26 is particularly effective in the variable displacement compressor 10.

It should be apparent to those skilled in the art that the present invention may be embodied in many other specific forms without departing from the spirit or scope of the invention. Particularly, it should be understood that the invention may be embodied in the following forms.

Figure 3:
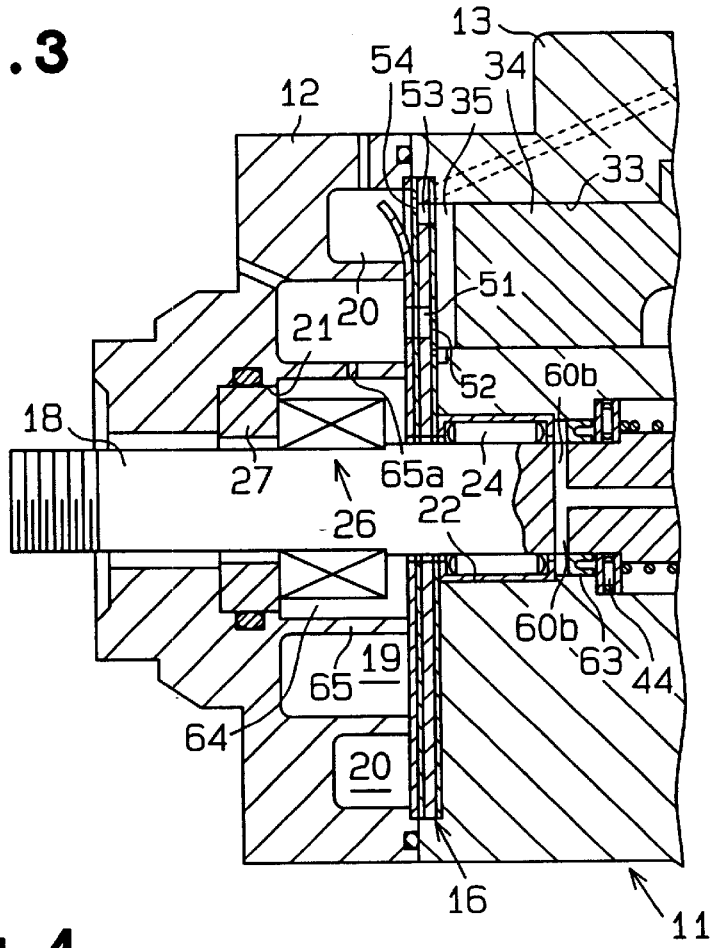
FIG. 3 is a partial cross-sectional view illustrating a compressor according to a second embodiment.

The sealing assembly 26 need not be located in the suction chamber 19. As in a second embodiment, which is illustrated in FIG. 3, a chamber 64 may be defined by a wall 65 and be located radially inside the suction chamber 19. The chamber 64 functions as a suction pressure zone that accommodates the sealing assembly 26, and the suction chamber 19 is connected to the chamber 64 through a hole 65*a*. The second embodiment has the substantially the same advantages as the first embodiment.

If the suction pressure chamber that accommodates the sealing assembly 26 is formed separately from the suction chamber 19, the suction chamber 19 may be radially outside of the discharge chamber 20.

Figure 4:
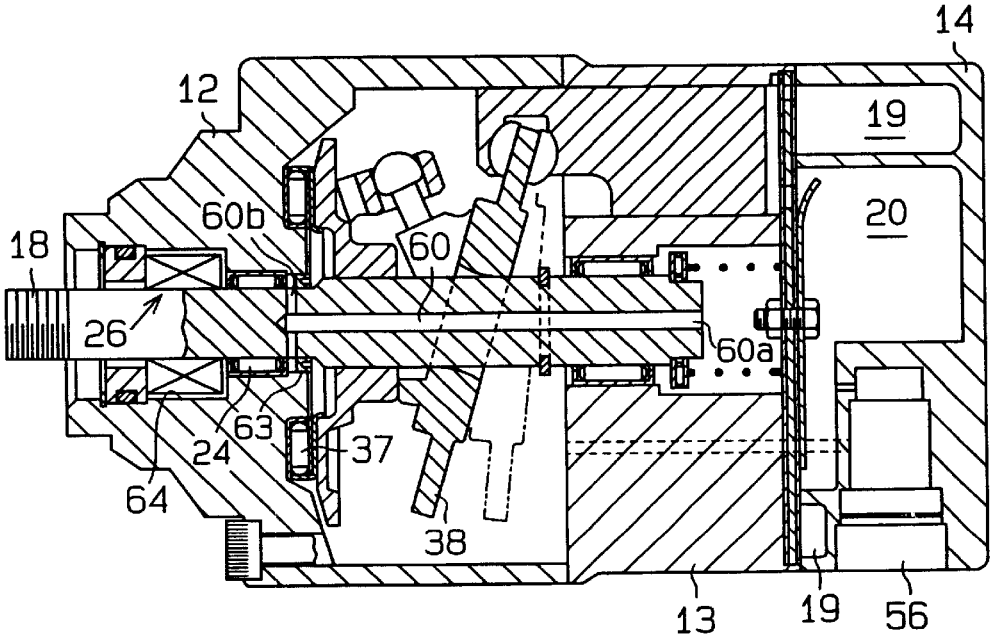
FIG. 4 is a cross-sectional view illustrating a compressor according to a third embodiment.

As in a third embodiment, which is illustrated in FIG. 4, the suction chamber 19 and the discharge chamber 20 may be located in the rear housing member 14, that is, the suction chamber 19 and the discharge chamber 20 may be located at a side opposite to the protruding portion of the drive shaft 18. The chamber 64, which functions as a suction pressure zone, is connected to the suction chamber 19 through a passage (not shown). The passage may be a pipe that is located outside the housing or may be formed in the housing.

The restrictor 61 of the bleed passage 60 may be omitted and the diameter of the bleed passage 60 may be constant.

The present invention may be embodied in a fixed displacement compressor.

The present invention may be adapted to a wobble plate type compressor. In this case, the swash plate 38, which rotates integrally with the drive shaft 18, is replaced with a wobble plate. The wobble plate rotates with respect to the drive shaft 18.

Figure 5:
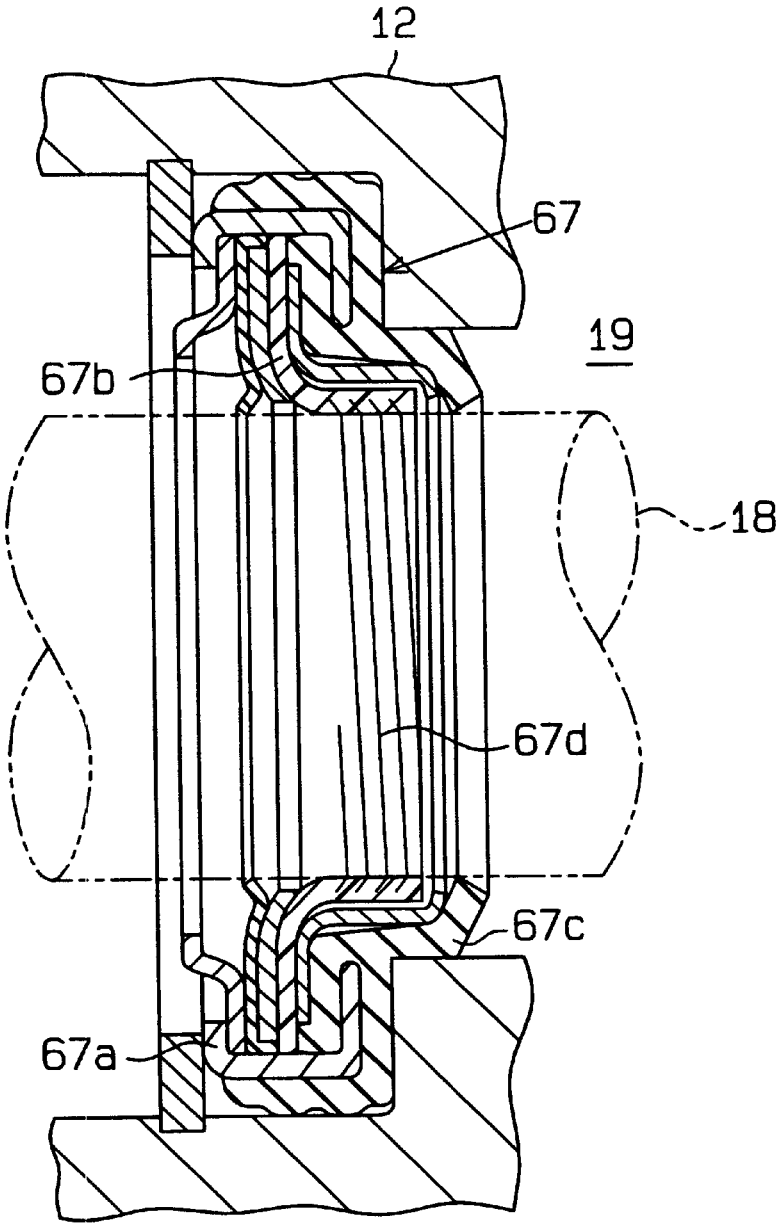
FIG. 5 is an enlarged partial cross-sectional view illustrating a shaft sealing assembly according to a fourth embodiment.
Figure 6:
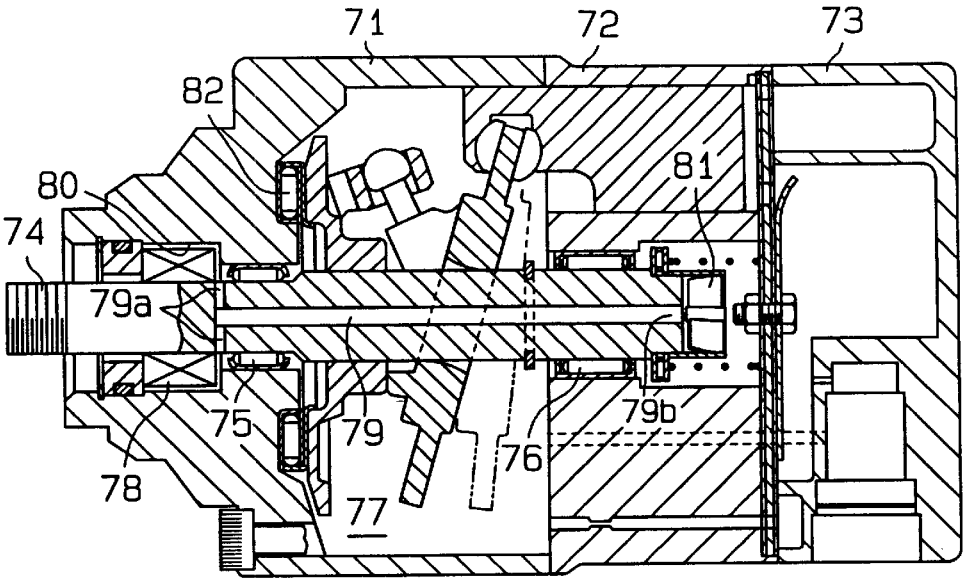
Fig.6(Prior Art)
FIG. 6 is a cross-sectional view illustrating a prior art compressor.
Figure 7:
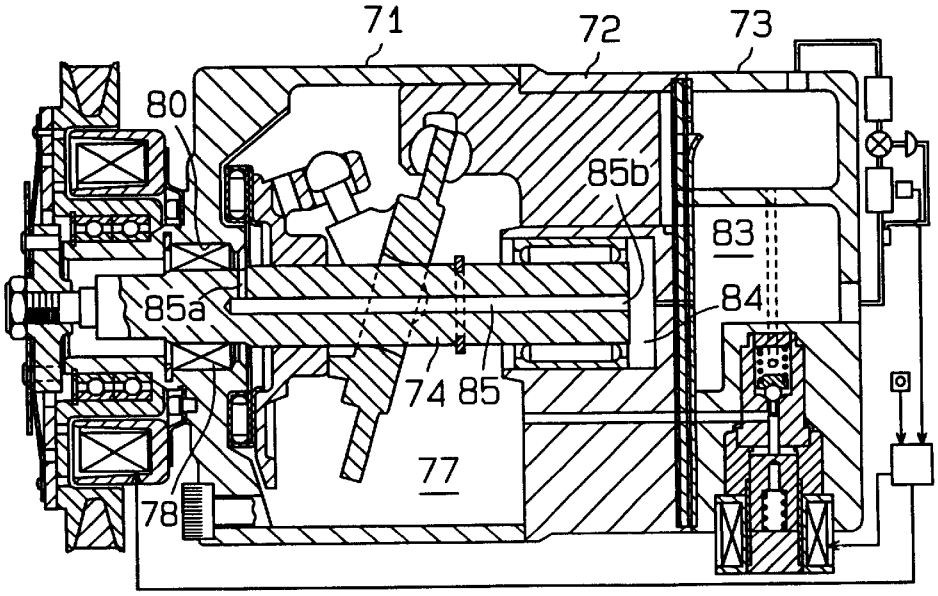
Fig.7(Prior Art)
FIG. 7 is a cross-sectional view illustrating another prior art compressor.

The shaft sealing assembly is not limited to the mechanical seal 26 but may be a lip seal. Using a lip seal reduces the cost of the sealing assembly and effectively seals against oil leakage. Particularly, a lip seal 67 according to a fourth embodiment, which is illustrated in FIG. 5, includes a metal body 67*a*, a resin lip ring 67*b* and a rubber lip ring 67*c*. The resin lip ring 67*b* and the rubber lip ring 67*c* are held by the metal body 67*a*. The resin lip ring 67*b* is made of, for example, a fluorocarbon resin. The multiple lip rings 67*b*, 67*c* improve the sealing characteristics. A helical groove 67*d* is formed on a surface of the lip ring 67*b* that slides on the drive shaft 18. The helical groove 67*d* is located about the axis of the drive shaft 18. Relative rotation of the groove 67*d* with the drive shaft 18 guides lubricant into the suction chamber 19, which further improves the oil sealing characteristics of the lip seal 67.

The control valve 56, which controls the opening size of the control passage, need not be an electromagnetic control valve. For example, an internally controlled valve like the control valve disclosed in Japanese Unexamined Patent Publication No. 6-123281 may be used. This valve has a diaphragm, which detects the suction pressure and is displaced accordingly, and a valve mechanism that controls the opening size of the control passage by a displacement of the diaphragm. However, when the present invention is applied to a clutchless type compressor, an electromagnetic valve, which can be externally controlled, is preferably used.

The power source of the compressor is not limited to the engine 50. However, the compressor may be driven by an electric motor. In this case, the present invention may be applied to an electric vehicle.

Figure 8:
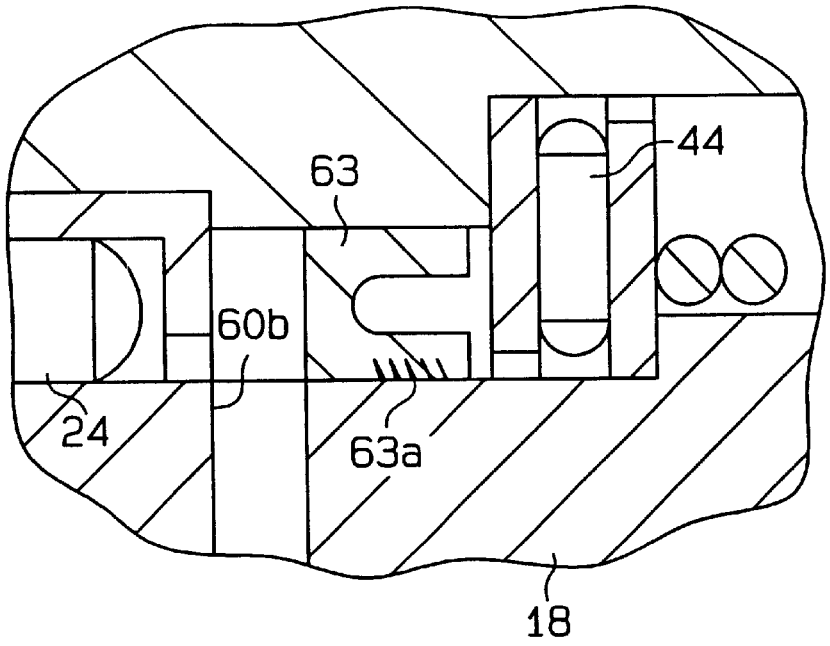
FIG. 8 is an enlarged partial cross-sectional view illustrating a compressor according to a fifth embodiment.

In a fifth embodiment, which is illustrated in FIG. 8, a helical groove 63*a* is formed in a part of the seal ring 63 that slides on the drive shaft 18. The helical groove 63*a* returns lubricant to the crank chamber 17 as the drive shaft 18 rotates. In this case, lubricant located between the seal ring 63 and the drive shaft 18 is returned to the crank chamber 17. As a result, excessive amount of lubricant is not supplied to the suction chamber 19, which prevents lubricant from leaking outside of the housing 11 from the sealing assembly 26.

Instead of forming the helical groove 63*a* in the seal ring 63, a helical groove may be formed in the drive shaft 18. In this case, the same advantages as the case of the helical groove 63*a* are obtained.

Therefore, the present examples and embodiments are to be considered as illustrative and not restrictive and the invention is not to be limited to the details given herein, but may be modified within the scope and equivalence of the appended claims.

What is claimed is:

1. A swash plate type compressor, comprising:

a housing, in which a suction chamber, a discharge chamber and a crank chamber are defined, the housing having at least one cylinder bore;

a drive shaft, which is rotatably supported by the housing, the drive shaft having a first end portion and a second end portion, wherein the first end portion protrudes from the housing;

first and second radial bearings, which support the first and second end portions of the drive shaft, respectively;

a piston, which is reciprocally accommodated in the cylinder bore;

a cam plate, which is accommodated in the crank chamber, wherein the cam plate is operably coupled to the piston to convert rotation of the drive shaft into reciprocation of the piston;

a shaft sealing assembly for sealing the space between the drive shaft and the housing, the shaft sealing assembly being accommodated in the suction chamber, wherein the suction chamber is closer to the first end portion of the drive shaft than the first radial bearing is; and a passage formed in the drive shaft to connect the suction chamber to the crank chamber, wherein the passage has an inlet and an outlet, wherein the inlet is closer to the second end portion than the second radial bearing is, and wherein the outlet is closer to the second end portion than the first radial bearing is.

2. The compressor according to claim 1, wherein the discharge chamber is located closer to the first end portion than the crank chamber is.

3. The compressor according to claim 1, wherein the cam plate is supported by the drive shaft such that the inclination angle of the cam plate can be changed, and wherein the compressor changes the inclination angle of the cam plate thereby altering the stroke of the piston.

4. The compressor according to claim 3, wherein a restrictor is located in the passage.

5. The compressor according to claim 1, wherein the shaft sealing assembly is a mechanical seal.

6. The compressor according to claim 1, wherein the shaft sealing assembly is a lip seal.

7. The compressor according to claim 1, further comprising a sealing mechanism, wherein the sealing mechanism is closer to the second end portion of the drive shaft than the outlet of the passage is, and wherein the sealing mechanism seals the outlet from the crank chamber.

8. The compressor according to claim 6, wherein the lip seal includes a plurality of lip rings.

9. The compressor according to claim 6, wherein a groove is formed in the lip seal, wherein the groove returns lubricant to the housing as the drive shaft rotates.

10. The compressor according to claim 1, wherein a filter is located in the passage.

11. The compressor according claim 4, wherein a filter is located upstream of the restrictor.

12. A swash plate type compressor, comprising:

a housing, in which a suction chamber, a discharge chamber and a crank chamber are defined, the housing having at least one cylinder bore;

a drive shaft, which is rotatably supported by the housing, the drive shaft having a first end portion and a second end portion, wherein the first end portion protrudes from the housing;

a piston, which is reciprocally accommodated in the cylinder bore;

a cam plate, which is accommodated in the crank chamber, wherein the cam plate is operably coupled to the piston to convert rotation of the drive shaft into reciprocation of the piston, wherein the inclination angle of the cam plate is controlled by controlling the pressure in the crank chamber and the displacement from the cylinder bore to the discharge chamber due to reciprocation of the piston is changed accordingly;

a shaft sealing assembly for sealing the space between the drive shaft and the housing, the shaft sealing assembly being accommodated in the suction chamber; and a sealing mechanism, which seals the suction chamber from the crank chamber, wherein a helical groove is formed either in the sealing mechanism or in the drive shaft, and wherein the helical groove generates flow of lubricant as the drive shaft rotates.

13. The compressor according to claim 12, wherein the helical groove returns lubricant to the crank chamber as the drive shaft rotates.

* * * * *